US011591858B2

(12) United States Patent
Yu et al.

(10) Patent No.: US 11,591,858 B2
(45) Date of Patent: Feb. 28, 2023

(54) CUTTING ELEMENTS WITH INCREASED CURVATURE CUTTING EDGES

(71) Applicants: CNPC USA CORPORATION, Houston, TX (US); BEIJING HUAMEI, INC., Beijing (CN); CHINA NATIONAL PETROLEUM CORPORATION, Beijing (CN)

(72) Inventors: Jiaqing Yu, Houston, TX (US); Chris X. Cheng, Houston, TX (US); Jianhua Guo, Beijing (CN); Bo Zhou, Beijing (CN); Shijun Qiao, Beijing (CN); Chuang Zhang, Beijing (CN); Xu Wang, Beijing (CN); Chi Ma, Beijing (CN); Xiongwen Yang, Beijing (CN)

(73) Assignees: CNPC USA CORPORATION, Houston, TX (US); BEIJING HUAMEI, INC., Beijing (CN); CHINA NATIONAL PETROLEUM CORPORATION, Beijing (CN)

( * ) Notice: Subject to any disclaimer, the term of this patent is extended or adjusted under 35 U.S.C. 154(b) by 0 days.

(21) Appl. No.: 17/247,478

(22) Filed: Dec. 11, 2020

(65) Prior Publication Data

US 2021/0180410 A1 Jun. 17, 2021

Related U.S. Application Data

(60) Provisional application No. 62/947,380, filed on Dec. 12, 2019.

(51) Int. Cl.
*E21B 10/43* (2006.01)
*E21B 10/567* (2006.01)
(Continued)

(52) U.S. Cl.
CPC ..... *E21B 10/58* (2013.01); *E21B 10/43* (2013.01); *E21B 10/54* (2013.01); *E21B 10/5673* (2013.01)

(58) Field of Classification Search
CPC ..... E21B 10/5673; E21B 10/58
See application file for complete search history.

(56) References Cited

U.S. PATENT DOCUMENTS

2008/0053710 A1* 3/2008 Moss ..... E21B 10/52 175/426
2019/0330928 A1* 10/2019 Graham ..... E21B 10/5676
2020/0347680 A1 11/2020 Tian et al.

FOREIGN PATENT DOCUMENTS

CN 110145243 A 8/2019
CN 209244514 U 8/2019
(Continued)

OTHER PUBLICATIONS

International Search Report and Written Opinion dated Apr. 2, 2021 for related PCT/US2020/070903.

*Primary Examiner* — Robert E Fuller
(74) *Attorney, Agent, or Firm* — Ramey LLP; William P. Ramey; Jacob B. Henry

(57) ABSTRACT

A drill bit for cutting formation comprises a bit body, a plurality of cutters, a plurality of blades with pockets to accommodate the cutters respectively. Each of the plurality of cutters has an ultra-hard layer, two side facets extending obliquely inward from the substrate to a top surface of the ultra-hard layer, a convex portion between the two side facets. The convex portion comprises a transition surface and the transitional surface is convex as it extends between adjacent the two side facets. The curvature of the transitional surface varies along the cutter axis with the curvature at the cutting edge larger than the curvature of the cutter circumferential surface.

14 Claims, 8 Drawing Sheets

(51) Int. Cl.
*E21B 10/54* (2006.01)
*E21B 10/58* (2006.01)

(56) References Cited

FOREIGN PATENT DOCUMENTS

| | | | | | |
|---|---|---|---|---|---|
| CN | 210460513 | U | | 5/2020 | |
| NO | 2019128956 | A1 | | 7/2019 | |
| WO | WO-2017053475 | A1 | * | 3/2017 | ..... E21B 10/5673 |
| WO | 2018231343 | A1 | | 12/2018 | |
| WO | WO-2020055882 | A1 | * | 3/2020 | ..... E21B 10/5673 |

* cited by examiner

CUTTING ELEMENTS WITH INCREASED CURVATURE CUTTING EDGES

CROSS-REFERENCE TO RELATED APPLICATIONS

The present application claims the benefit of U.S. Provisional Application No. 62/947,380, filed Dec. 12, 2019, the entirety of which is incorporated by reference herein.

FIELD

The disclosure relates generally to drill bits in the oil and gas industry. The disclosure relates specifically to cutting elements in the field of drill bits for petroleum exploration and drilling operation.

BACKGROUND

When drilling a borehole, such as for the recovery of hydrocarbons or for other applications, it is conventional practice to connect a drill bit on the lower end of a drill string. The bit is rotated by rotating the drill string at the surface or by actuation of downhole motors or turbines, or by both methods. The drill bit is rotated and advanced into the subterranean formation. As the drill bit rotates, the cutters or abrasive structures thereof cut, crush, shear, and/or abrade away the formation material to form the borehole.

Referring to FIG. 1, a conventional bit adapted for drilling through formations of rock to form a borehole is shown. The bit includes a drill bit body 3 and a plurality of blades 4 and a connection or pin 32 for connecting the bit to a drill string (not shown) which is employed to rotate the bit around longitudinal bit axis 6 to drill the borehole. The blades 4 are separated by channels or gaps that enable drilling fluid to flow through and both clean and cool the blades 4 and cutters 5. Cutters 5 are held in the blades 4 at predetermined angular orientations and radial locations to present working surface 503 with a desired back rake angle against a formation to be drilled. A fluid channel 31 is formed in the drill bit body 3 and a plurality fluid holes 33 communicate with the fluid channel. Fluid can be pumped to discharge drilling fluid in selected directions and at selected rates of flow between the cutting blades 4 for lubricating and cooling the drill bit, the blades 4 and the cutters 5. The drilling fluid also cleans and removes the cuttings as the drill bit rotates and penetrates the formation.

The drill bit body 3 is substantially cylindrical. The plurality of the cutters 5 are disposed on the outer edge of the blade 4, furthermore, the outer edge of the blade 4 comprises a cone portion 431, a nose portion 432, a shoulder portion 433 and a gauge protection portion 434. The cone portion 431 is close to the central axis.

Of the drill bit body 3, the gauge protection portion 434 is located on the side wall of the drill bit body 3 and the cutters 5 are distributed across the cone portion 431, the nose portion 432, the shoulder portion 433 and the gauge protection portion 434 of the blades 4.

Referring to FIGS. 2A-2C, a typical cutter 5 is substantially cylindrical, including a cylindrical bottom portion and a cylindrical top portion. The bottom portion, called substrate 504, is usually made from hard composites such as tungsten carbide, and top portion, called ultra-hard layer 502, is typically made from hard and abrasive material such as polycrystalline diamond (PCD). Substrate 504 and ultra-hard layer 502 are sintered together through high pressure high temperature process. On the top end of the ultra-hard layer 502, a chamfer 507 is machined to increase the durability of the cutting edge while running into the borehole and at the inception of drilling, at least along the portion which initially contacts the formation. It is noted that at least a portion of the chamfer 507 may also function as a working surface that contacts a subterranean formation during drilling operations. The top surface 503 of the ultra-hard layer 502 and the chamfer surface 507 intersect at the top cutting edge 513, the cylindrical side surface 512 of the ultra-hard layer 502 and the chamfer surface 507 also intersect at the lower cutting edge 514 which is the main formation cutting edge whose curvatures is the same as that of the cutter outer cylindrical surface 504. Since the chamfer 507 is drawn inward from the lower cutting edge 514 to the top cutting edge 513, the curvature of the lower edge of the chamfer is smaller than that of the top cutting edge 513.

The drill bits utilize different sizes of the cutters for different applications. For example, cutters with small diameters are typically used for drilling hard formation because their larger curvature cutting edges are easy to penetrate or bite into the formation. Cutters with large diameters are used for drilling relatively soft formation because they can extend more from the bit blades, allowing high penetration rate.

However, selecting the best size of a cutter is not always straightforward because many formations have mixed characteristics (i.e., the geological formation may include both hard and soft zones), depending on the location and depth of the well bore. Changes in the geological formation can affect the desired type of a cutter, the desired rate of penetration of a bit, the desired rotation speed, and the desired downward force or weight-on-bit. Where a cutter is operated outside the desired ranges of operation, the cutter can be damaged or the life of the cutter can be severely reduced. A cutter normally operated in one general type of formation may penetrate into a different formation. For example, a cutter with large diameter may penetrate into an unexpected hard formation, thereby causing the cutter intermittently bites into the geological formation and reducing the desired rate of penetration.

Trying to allow large-diameter cutters to bite into the formation easily, a wedge-type cutter has been developed. Referring to FIGS. 3A-3C, perspective view, front view and top view of a wedge-type cutter are shown. FIG. 3A can be regarded as portions of the cutter in FIG. 2A are cut off, a convex portion 524 extends between substantially planar facets 520 and 521. The cross-section area where the cutter interacts with the formation is reduced because of the cut off portions such that the cutter bites into the formation easier. However, the curvature of the cutting edge remains the same as that of the cutter periphery, requiring the same force acting on the cutter to break the formation. This can place greater loading, excessive shear forces, and additional heat on the working surface of the cutters which will decrease the service life of the cutter.

It is, therefore, desired that a cutter be developed that provides improved cutting efficiency and service life.

SUMMARY

In one aspect, the present disclosure is directed to a cutter used on a drill bit for cutting formation. The drill bit comprises a bit body, a plurality of cutters, and a plurality of blades with pockets to accommodate the cutters respectively. Each of the plurality of cutters has an ultra-hard layer, two side facets extending obliquely inward from the substrate to a top surface of the ultra-hard layer, a convex portion between the two side facets. The convex portion comprises a transitional surface and the transitional surface is convex as it extends between adjacent the two side facets. The curvature of the transitional surface increases with the central axial from bottom of the transitional surface to top of the transitional surface. The curvature of the transitional surface varies along a central axis of the substrate. The variation of the curvature of the transitional surface is continuous or discontinuous. The transitional surface is machined by Electrical Discharge Machining, Laser Ablation, Grinding, or other material reduction methods. The ultra-hard layer is formed of PCD (Polycrystalline Diamond).

In some embodiments, the two side facets are planar, convex, concave or combination of the aforementioned.

In some embodiments, the ultra-hard layer comprises a planar top surface or a protruding dome shaped top surface. In some embodiments, the ultra-hard layer comprises an undulated top surface.

In some embodiments, the ultra-hard layer comprises multiple flat top surfaces such as two slant flat surfaces or three slant flat surfaces. In some embodiments, the ultra-hard layer comprises a concave shaped top surface.

In another aspect, the present disclosure is directed to a drill bit for cutting formation. The drill bit comprises a bit body, a plurality of cutters of the present disclosure, a plurality of blades with pockets to accommodate the cutters respectively.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

Figure 4A:
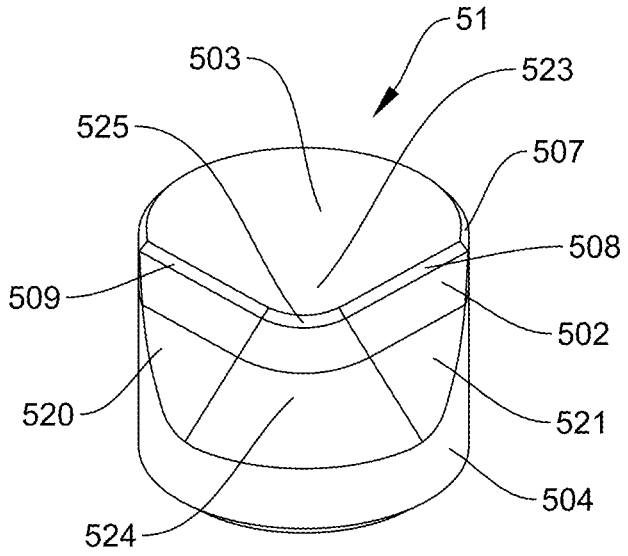
FIG. 4A is a perspective view of a wedge-type with cutter with plane top surface in accordance with one embodiment of the present disclosure.
Figure 4B:
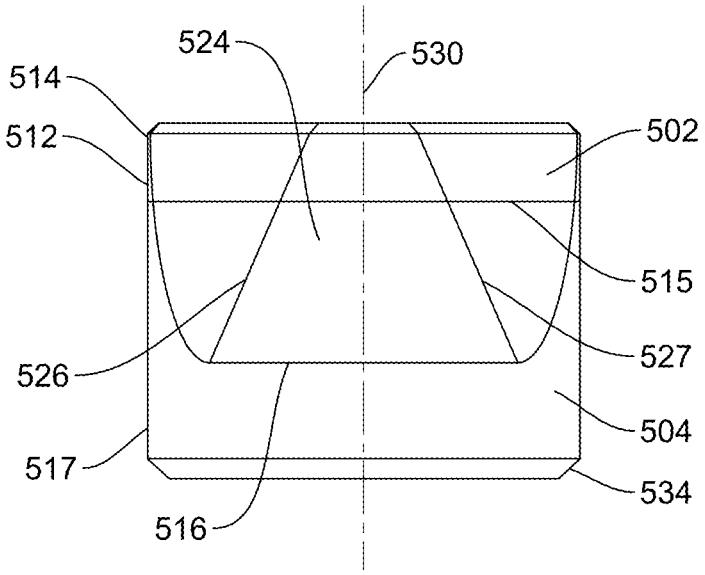
FIG. 4B is a front view of the wedge-type cutter in FIG. 4A.
Figure 4C:
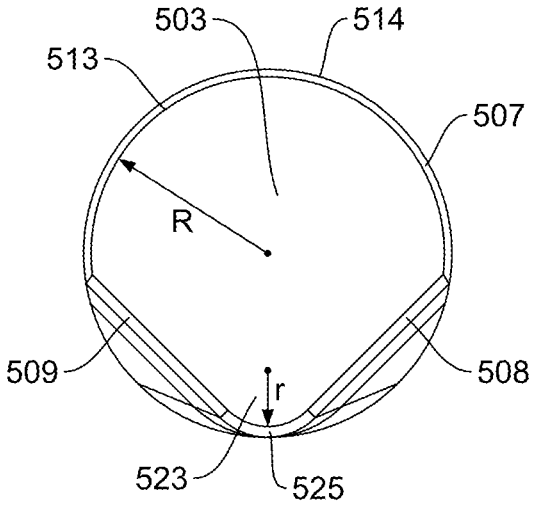
FIG. 4C is a top view of the wedge-type cutter in FIG. 4A.

FIGS. 4A-4C illustrate an embodiment of a wedge-type cutter 51 of the present disclosure. In accordance with the present disclosure, the cutter 51 has a cylindrical substrate 504 and an ultra-hard layer 502 disposed thereon. The substrate 504 has a central axis 530 and a generally cylindrical side surface 517. The top surface 503 is formed perpendicular to the central axis 530 at a distal end of the ultra-hard layer 502. The substrate 504 may be formed from any substrate material known in the art, for example, cemented tungsten carbide. Ultra-hard layer 502 may be formed from any ultra-hard material known in the art, for example, polycrystalline diamond or polycrystalline cubic boron nitride. A bottom surface (not shown) of the ultra-hard layer 502 is bonded on to an upper surface (not shown) of the substrate 504. The surface junction between the bottom surface and the upper surface are herein collectively referred to as interface 515. The substrate 504 has a chamfered corner 534 which facilitates insertion and mounting of cutter 51 into the receiving aperture formed in the drill bit. Although substrate 504 is cylindrical having a circular cross-section in this embodiment, substrate 504 may likewise have a non-circular cross-section (e.g., cross-section of the substrate 504 may be oval, rectangular, asymmetric, etc.). On the top end of the ultra-hard layer 502, a chamfer 507 is machined. The top surface 503 of the ultra-hard layer 502 and the chamfer 507 meet at the top cutting edge 513, the cylindrical side surface 512 of the ultra-hard layer 502 and the chamfer 507 meet at the lower cutting edge 514.

Figure 1:
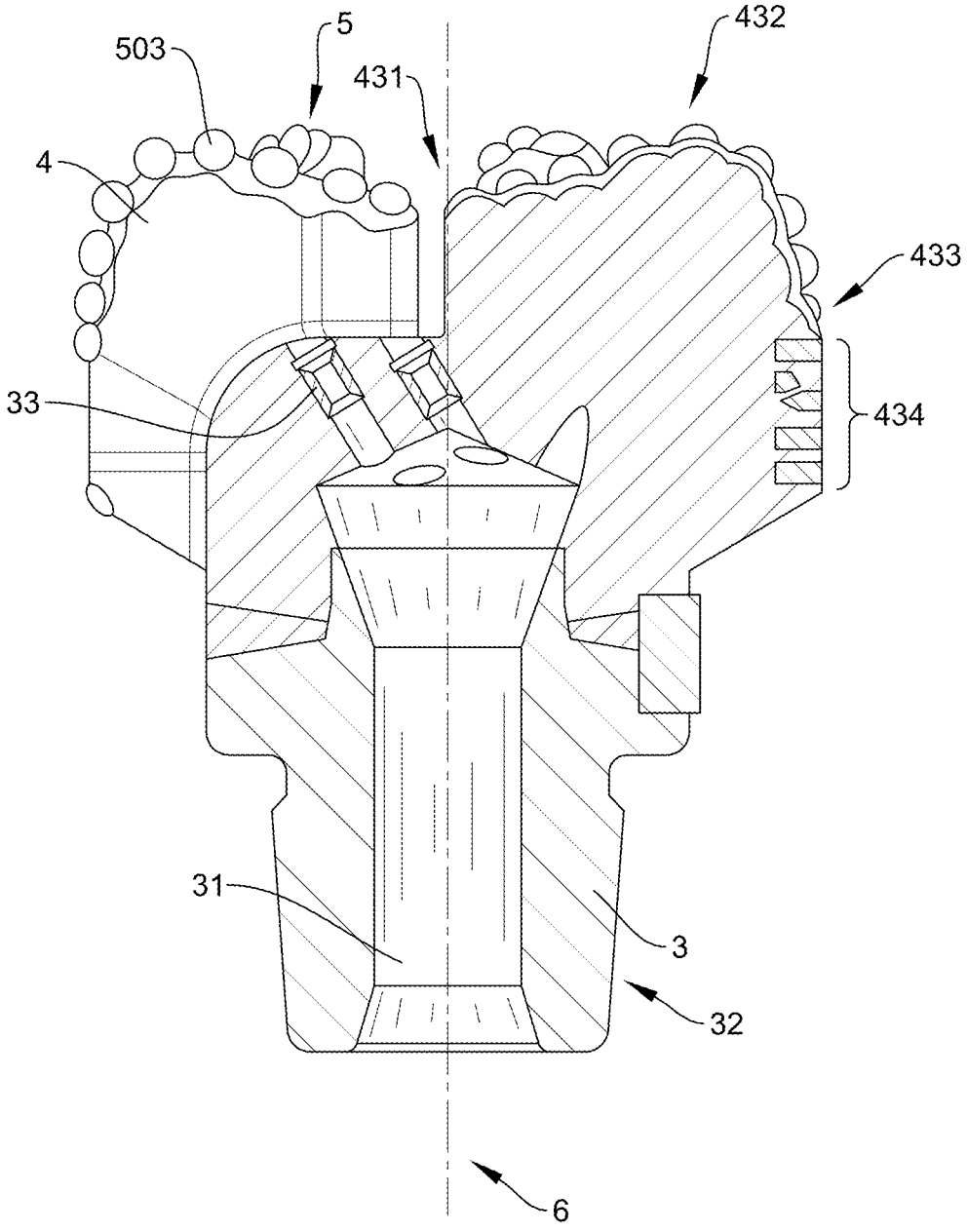
Prior Art FIG. 1
FIG. 1 is a sectional view of a prior art drill bit.
Figure 2A:
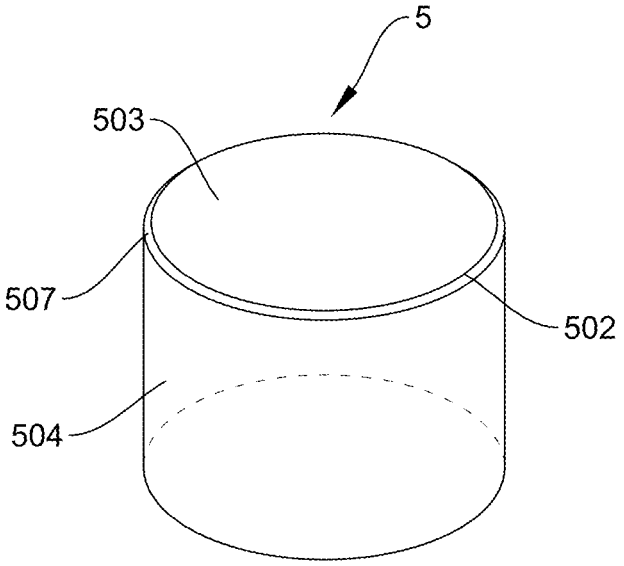
Prior Art FIG. 2A
FIG. 2A is a perspective view of a prior art cutter with plane working surface.
Figure 2B:
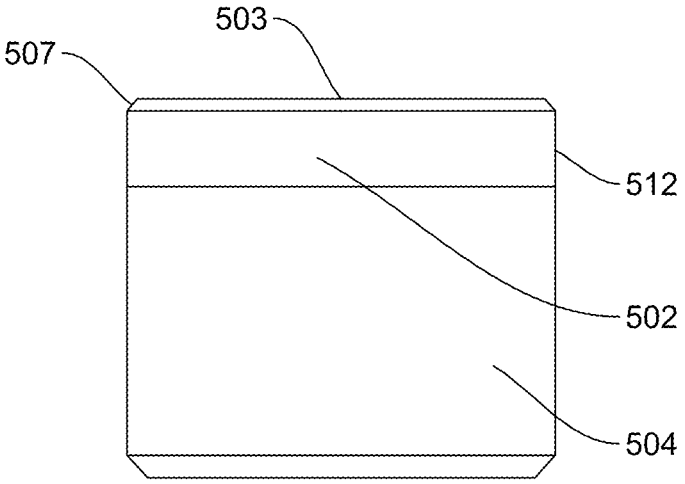
Prior Art FIG. 2B
FIG. 2B is a front view of the cutter in FIG. 2A.
Figure 2C:
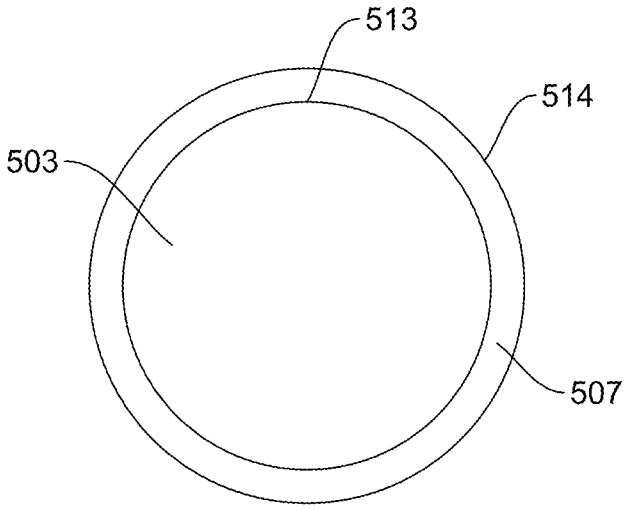
Prior Art FIG. 2C
FIG. 2C is a top view of the cutter in FIG. 2A.
Figure 3A:
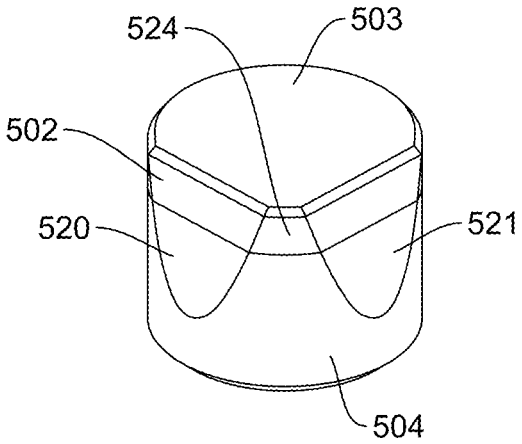
Prior Art FIG. 3A
FIG. 3A is a perspective view of a wedge-type cutter.
Figure 3B:
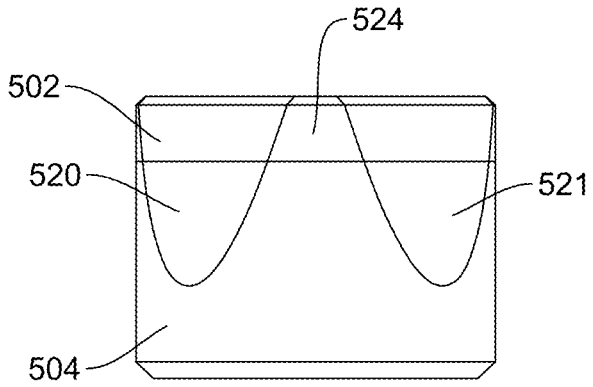
Prior Art FIG. 3B
FIG. 3B is a front view of the wedge-type cutter in FIG. 3A.
Figure 3C:
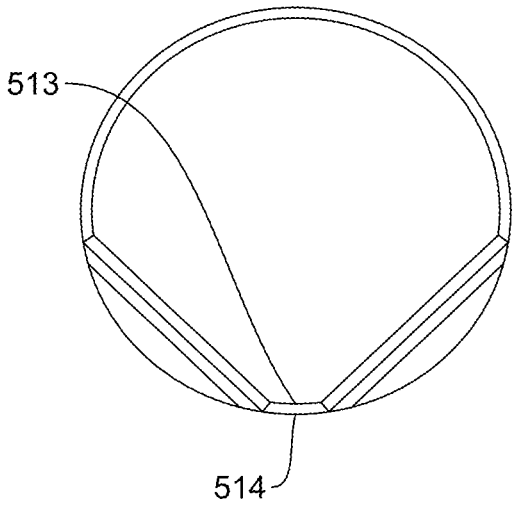
Prior Art FIG. 3C
FIG. 3C is a top view of the wedge-type cutter in FIG. 3A.

The cutter 51 includes two side facets 520 and 521. The side facets 520 and 521 extent obliquely inward from the substrate 504 to the top surface 503. Thus they can be regarded as portions of the substrate 504 and ultra-hard layer 502 in FIG. 2A are cut off. The side facets 520 and 521 are generally planar but need not be absolutely flat. For example, side facets 520 and 521 may be slightly convex or slightly concave. Given the substantially planar side facets 520 and 521 of this embodiment, the intersection of facets 520 and 521 with generally flat top surface 503 provide edge segments 508, 509 that extend generally linearly. A convex portion 523 is located between the two side facets 520 and 521, the convex portion 523 has a transitional surface 524. The transitional surface 524 is generally convex or outwardly bowed as it extends between adjacent facets 520 and 521. The transitional surface 524 meets the two facets 520 and 521 at edge 526 and 527 respectively. The transitional surface 524 may or may not be tangent to the side facets 520 and 521. The transitional surface 524 meets the cylindrical surface on the substrate at the edge 516 and meets the top surface 503 at the edge segment 525. In some embodiments, edge segments 508, 509 and 525 are machined to form chamfers to increase the durability of the cutting edge. Thus, the side surface of the cutter includes four portions, one cylindrical surface 517, two side facets 520 and 521, and one transitional surface 524 between the side facets. The cylindrical surface is the cutter circumferential surface 517.

As shown in FIG. 4A, the curvature of the transitional surface 524 varies along the central axis 530. In particular, the curvature of the transitional surface 524 increases with the axial distance from edge 516 to edge segment 525. In some embodiment, the variation of the curvature of the transitional surface 524 is continuous, in some embodiment, the variation of the curvature of the transitional surface 524 is discontinuous. The radius of cutter 51 is R, the radius of the convex portion 523 decreases with the axial distance from edge 516 to edge segment 525, the radius of the convex portion 523 is Rat the edge 516 and is rat the edge segment 525, where r<R. Correspondingly, the cross-sectional area of the convex portion 523 decreases from edge 516 to edge segment 525 along the axis 530.

The process for making a cutter may employ a body of cemented tungsten carbide as the substrate where the tungsten carbide particles are cemented together with cobalt. The carbide body is placed adjacent to a layer of ultra-hard material particles such as diamond or cubic boron nitride particles and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the cemented tungsten carbide substrate.

The two side facets 520 and 521 and the transitional surface 524 can be machined by Electrical Discharge Machining (EDM), Laser Processing (LP), Grinding or other material reduction methods. EDM is a kind of method to process the size of materials which employs the corrosion phenomena produced by spark discharge. In a low voltage range, EDM performs spark discharge in liquid medium. EDM is a self-excited discharge, which is characterized as follows: before discharge, there is a higher voltage between two electrodes used in spark discharge, when the two electrodes are close, the dielectric between them is broken down, spark discharge will be generated. In the process of the break down, the resistance between the two electrodes abruptly decreases, the voltage between the two electrodes is thus lowered abruptly. Spark channel must be promptly extinguished after maintaining a fleeting time, in order to maintain a "cold pole" feature of the spark discharge, that is, there's not enough time to transmit the thermal energy produced by the channel energy to the depth of the electrode. The channel energy can corrode the electrode partially. When processing diamond composite sheet with EDM, since the residual catalyst metal cobalt produced in the process sintering diamond composite sheet having conductivity, the diamond composite sheet can be used as electrodes in the EDM, and thus can be machined by EDM.

EDM can avoid the error caused by the inability to accurately control the diamond shrinkage during sintering process. EDM technology can effectively control the machining accuracy and can reduce the damage to the substrate 504 during the machining process. The transitional surface 524 formed by electric spark machining have characteristics of high processing precision, low cost, small damage to the substrate 504 and so on.

Figure 5A:
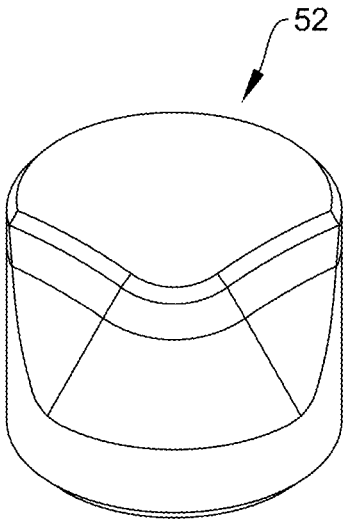
FIG. 5A is a perspective view of a wedge-type cutter with dome top surface in accordance with one embodiment of the present disclosure.
Figure 5B:
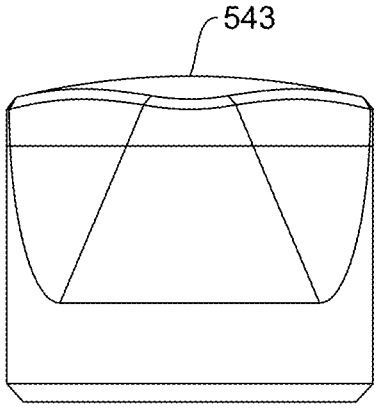
FIG. 5B is a front view of the wedge-type cutter in FIG. 5A.
Figure 5C:
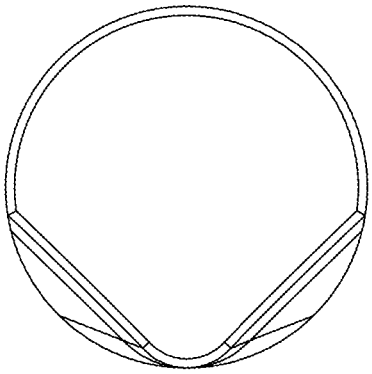
FIG. 5C is a top view of the wedge-type cutter in FIG. 5A.

The top surface of the ultra-hard layer can be of flat or in any other forms. FIGS. 5A-5C illustrate an alternative embodiment of a wedge-type cutter 52 of the present disclosure. The components of the wedge-type cutter 52 are substantially the same as those of the wedge-type cutter 51 in FIGS. 4A-4C except that the cutter 52 has a protruding dome shaped top surface 543. The dome shaped top surface 543 provides substantial strength and durability during the formation cutting process.

Figure 6A:
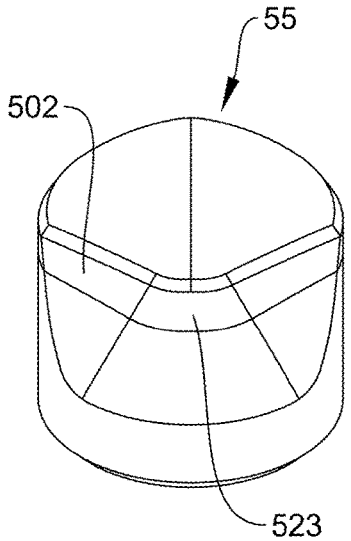
FIG. 6A is a perspective view of a wedge-type cutter with two slant flat top surfaces in accordance with one embodiment of the present disclosure.
Figure 6B:
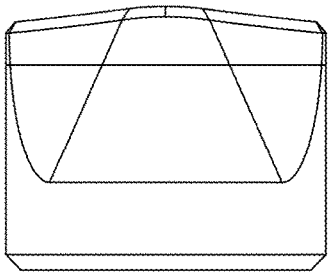
FIG. 6B is a front view of the wedge-type cutter in FIG. 6A.
Figure 6C:
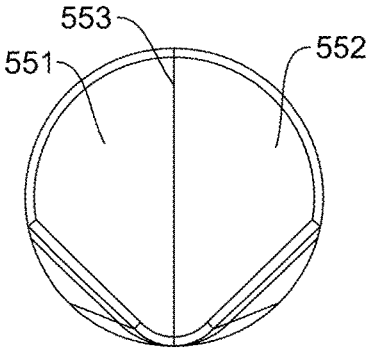
FIG. 6C is a top view of the wedge-type cutter in FIG. 6A.

The top surface of the ultra-hard layer can compose of multiple flat surfaces, such as two slant flat surfaces shown in FIGS. 6A-6C. The components of the wedge-type cutter 55 are substantially the same as those of the wedge-type cutter 51 in FIGS. 4A-4C. The difference is that the cutter 55 has two slant flat surfaces 551 and 552 on the top of the ultra-hard layer 502. The two slant flat surfaces 551 and 552 increase gradually from periphery of the ultra-hard layer 502 to the center and meet at a convex ridge 553. The convex ridge 553 is on the axisymmetric plane of the convex portion 523.

Figure 7A:
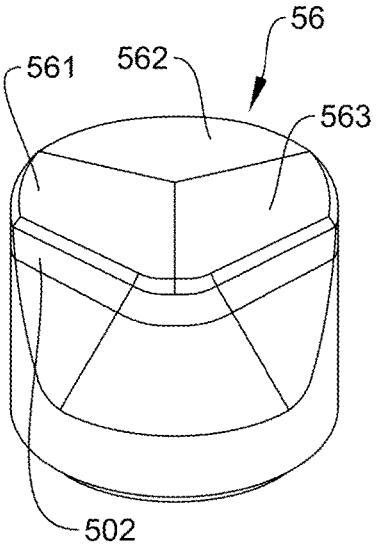
FIG. 7A is a perspective view of a wedge-type cutter with three slant flat top surfaces in accordance with one embodiment of the present disclosure.
Figure 7B:
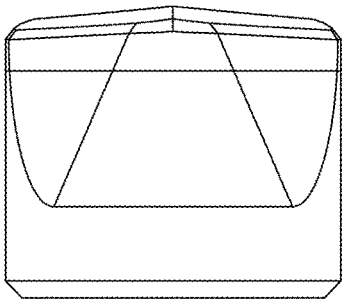
FIG. 7B is a front view of the wedge-type cutter in FIG. 7A.
Figure 7C:
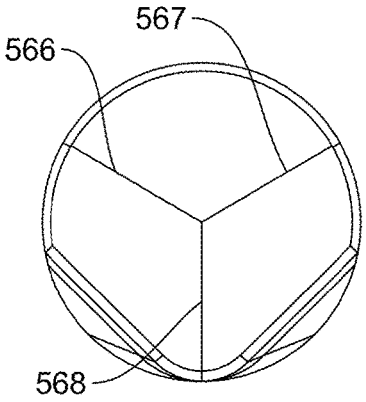
FIG. 7C is a top view of the wedge-type cutter in FIG. 7A.

FIGS. 7A-7C illustrate another embodiment of a wedge-type cutter 56 of the present disclosure. The components of the wedge-type cutter 56 are substantially the same as those of the wedge-type cutter 51 in FIGS. 4A-4C. The difference is that the cutter 56 has three slant flat surfaces 561, 562 and 563 on the top of the ultra-hard layer 502. The three slant flat surfaces are inclined outwardly and downwardly along axial direction of the cutter 56. The three slant flat surfaces 561, 562 and 563 intersect with each other to form three convex ridges 566, 567 and 568. The inner end of the three convex ridges converge at the center of the upper surface of the ultra-hard layer 502, the outer end of the three convex ridges extend to the outer edge of the top surface of the ultra-hard layer 502 such that the three convex ridges form a substantially "Y" type pattern. The convex ridges can greatly improve the ability of positive direction impact resistance of the cutter. In addition, the convex ridge which is located at the outer end of the edge of the top surface of the ultra-hard layer 502 act as cutting points.

Figure 8A:
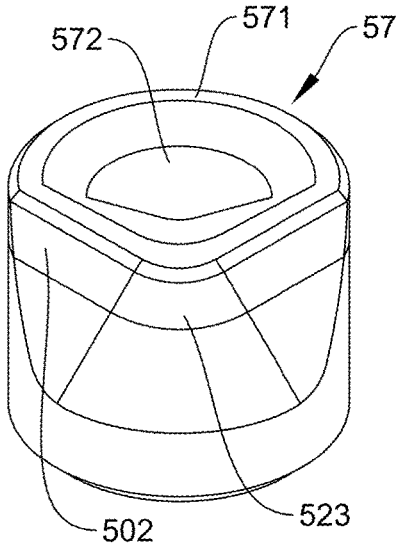
FIG. 8A is a perspective view of a wedge-type cutter with concave surface in accordance with one embodiment of the present disclosure.
Figure 8B:
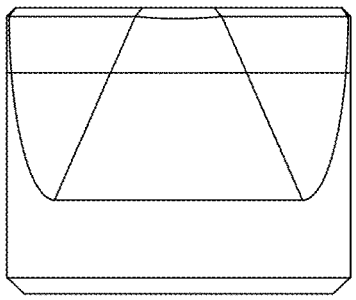
FIG. 8B is a front view of the wedge-type cutter in FIG. 8A.
Figure 8C:
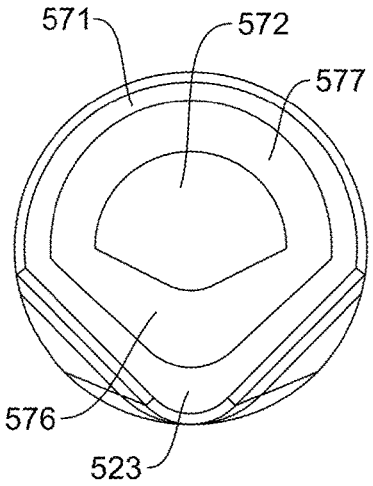
FIG. 8C is a top view of the wedge-type cutter in FIG. 8A.

FIGS. 8A-8C illustrate yet another embodiment of a wedge-type cutter 57 of the present disclosure. The components of the wedge-type cutter 57 are substantially the same as those of the wedge-type cutter 51 in FIGS. 4A-4C. The difference is that the cutter 57 has concave shaped top surface. The ultra-hard layer 502 includes a concave surface 572 in the central region of the top surface, a flat or angled surface 571 to be around entire periphery or portion of periphery of the cutter. A tapered surface 576 adjacent to the convex portion 523 which is used as cutting edge gives desired back rake angle, and the tapered surface opposite to the cutting edges acts as a chip breaker 577, breaking cutting ribbons and directing cuttings away from the cutting surface. The material that is removed from the formation, in the form of chips or other debris, may be removed without exerting significant compressive forces on the formation. The chips or other debris may be broken into smaller pieces as they impact another portion of the faces of the cutter. The cutter may also prevent the chips or other debris from collecting on a face of the drill bit, and instead direct the chips or other debris into the drill bit's hydraulic flows, which may carry the chips or other debris away from the drill bit.

Figure 9A:
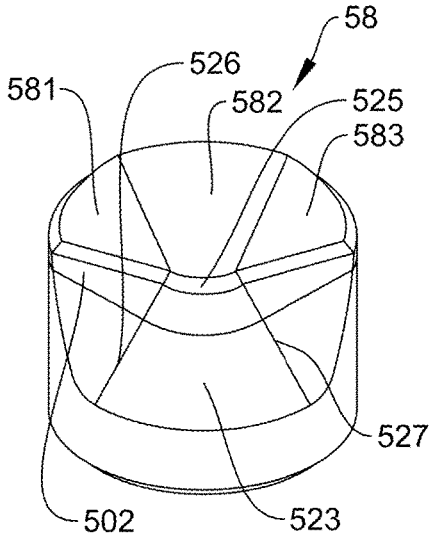
FIG. 9A is a perspective view of a wedge-type cutter with three flat top surfaces in accordance with one embodiment of the present disclosure.
Figure 9B:
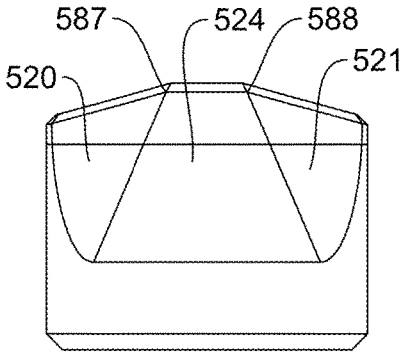
FIG. 9B is a front view of the wedge-type cutter in FIG. 9A.
Figure 9C:
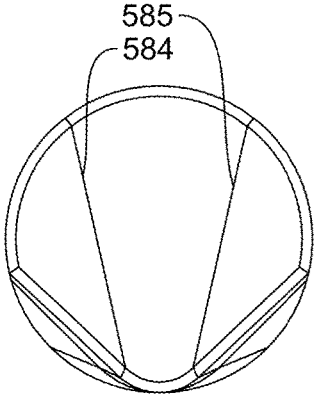
FIG. 9C is a top view of the wedge-type cutter in FIG. 9A.

FIGS. 9A-9C illustrate another embodiment of a wedge-type cutter 58 of the present disclosure. The cutter 58 has three surfaces 581, 582 and 583 on the top of the ultra-hard layer 502. Two side surfaces 581 and 583 are inclined outwardly and downwardly along axial direction of the cutter 58, and intersect with the central surface 582 at edges 584 and 585, respectively. The side surfaces 581 and 583 can be flat, dome, concave or undulated surfaces. The central surface 582 can be a flat surface, parallel or not parallel to the bottom surface of the cutter. It can also be a dome, concave or other shaped surface. The central surface intersects the transitional surface 524 at edge 525, forming the cutting edge or partial cutting edge.

The convex portion 523 has a transitional surface 524 extending between adjacent facets 520 and 521. The transitional surface 524 meets the two facets 520 and 521 at edges 526 and 527 respectively. The edge 526 and the edge 584 meet at point 587 on the chamfer while the edge 527 and the edge 585 meet at point 588 on the chamfer. The points 587 and 588 can help to cut the formation.

The cutter can be net shaped from sintering process instead of machining after sintering.

In some embodiments, the present disclosure also provides a drill bit, which comprises above mentioned wedge-type cutters.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A cutter comprising a substrate;

an ultra-hard layer;

two side facets extending obliquely inward from the substrate to a top surface of the ultra-hard layer; and a convex portion between the two side facets, wherein the top surface of the ultra-hard layer forms at least two intersecting planes of equal area;

wherein the convex portion comprises a transitional surface, wherein the transitional surface is convex as the transitional surface extends between the two side facets; and wherein a radius of curvature of the transitional surface varies along a central axis of the substrate.

2. The cutter of claim 1, wherein the radius of curvature of the transitional surface decreases along the central axis from bottom of the transitional surface to top of the transitional surface.

3. The cutter of claim 2, wherein the radius of curvature at the top of the transitional surface is smaller than the radius of curvature of the cutter circumferential surface.

4. The cutter of claim 1, wherein variation of the radius of curvature of the transitional surface is continuous.

5. The cutter of claim 1, wherein the transitional surface is a partial conical surface.

6. The cutter of claim 1, wherein the two side facets are planar.

7. The cutter of claim 1, wherein the two side facets are convex.

8. The cutter of claim 1, wherein the top surface of the ultra-hard layer comprises a slanted flat top surface.

9. The cutter of claim 1, wherein the ultra-hard layer is formed of PCD.

10. The cutter of claim 1, wherein the transition surface is machined by Electrical Discharge Machining, Laser Processing, Grinding or other material reduction methods.

11. The cutter of claim 1, where the cutter is net shaped from sintering process.

12. The cutter of claim 1, wherein the transitional surface is a partial lateral surface of an oblique cone.

13. A drill bit comprising at least one cutter of claim 1.

14. The drill bit of claim 13, wherein the ultra-hard layer comprises multiple flat top surfaces.

* * * * *